United States Patent [19]

Van Deijk

[11] Patent Number: 4,606,469

[45] Date of Patent: Aug. 19, 1986

[54] DOUBLE LINK LEVEL LUFFING CRANE

[75] Inventor: Jan D. A. Van Deijk, Barendrecht, Netherlands

[73] Assignee: Frans Swarttour B. V., Rotterdam, Netherlands

[21] Appl. No.: 778,298

[22] Filed: Sep. 23, 1985

Related U.S. Application Data

[63] Continuation of Ser. No. 523,666, Aug. 15, 1983, abandoned.

[30] Foreign Application Priority Data

Aug. 16, 1982 [NL] Netherlands ..... 8203338

[51] Int. Cl.[4] ..... B66C 23/10; B66C 23/52

[52] U.S. Cl. ..... 212/256; 212/190; 212/192; 212/232; 212/252; 212/165; 182/2

[58] Field of Search ..... 212/190–194, 212/160, 165, 187–188, 206, 218, 211, 227–244, 255–256; 180/89.12–89.15; 296/190; 182/2

[56] References Cited

U.S. PATENT DOCUMENTS

| | | | |
|---|---|---|---|
| 2,703,180 | 3/1955 | Brown | 212/239 |
| 3,080,981 | 3/1963 | Kuschel et al. | 212/165 |
| 4,049,132 | 9/1977 | Strömbäck | 212/206 |
| 4,257,491 | 3/1981 | Presnall, Jr. et al. | 182/2 |

FOREIGN PATENT DOCUMENTS

| | | | |
|---|---|---|---|
| 39529 | 11/1981 | European Pat. Off. | 212/239 |
| 610687 | 3/1935 | Fed. Rep. of Germany | 212/191 |
| 1073179 | 1/1960 | Fed. Rep. of Germany | 212/256 |
| 1456493 | 1/1970 | Fed. Rep. of Germany | 212/211 |
| 7810056 | 4/1980 | Netherlands | 212/147 |
| 119323 | 4/1956 | U.S.S.R. | 212/165 |

*Primary Examiner*—Trygve M. Blix
*Assistant Examiner*—R. B. Johnson
*Attorney, Agent, or Firm*—Parmelee, Bollinger & Bramblett

[57] ABSTRACT

To enable the crane driver of a double link level luffing crane to adapt the height of his cab above the ground to the size of the ship to be loaded or unloaded, the drivers cab is mounted at the end of a separate cab link having a hinge connection with a carriage movable on the strut member of the crane.

2 Claims, 6 Drawing Figures

DOUBLE LINK LEVEL LUFFING CRANE

This is a continuation of co-pending application Ser. No. 523,666 filed on Aug. 15, 1983, now abandoned.

BACKGROUND OF THE INVENTION

The invention relates to a double link level luffing crane comprising a base, jib including a strut member hinged to the base, a backstay member hinged to the base and a jib head member, drive means for luffing the crane in and out, hoisting equipment, a drivers cab mounted on a cab link, and means for pivoting the cab link during luffing of the crane so that the drivers cab moves along a substantially horizontal path.

Such a crane is known from German Auslegeschrift No. 1,161,669.

In luffing a double link level luffing crane the pulley block at the free end of the jib head member will move along a substantially horiztonal path. This means that the load also moves along a substantially horizontal path and the free length of the cable of the hoisting equipment remains the same. As a consequence higher turning and luffing speeds are possible. An important advantage of the double link level luffing crane is that the length of the cable underneath the pulley block is rather small, so that the positioning of the grab is easier and the grab is less likely to swing during positioning.

In addition the crane according to said German Auslegeschrift is advantageous as the crane drivers cab will move along a substantially horizontal path during the luffing movement and the driver will be in a good position to observe loading and unloading. However, the height position of the cab is fixed. In the embodiment shown this position is rather low and as a consequence it is unsuitable for loading and unloading of a rather big ship. If the fixed height position of the cab is chosen to be much higher, the crane driver in loading or unloading a rather small ship would be at such an elevation that his sight on the ship and especially on the load in the hold would be poor.

The object of the invention is to give the cab of a crane such a position that the crane driver may have an optimal sight on the loading and unloading by selecting the height of the cab.

SUMMARY OF THE INVENTION

Therefore according to the invention the crane is characterized in that the cab link has a hinge connection with a carriage movable on a strut member.

The cab will move along with the luffing movement of the strut member. The strut member is a strong stable construction, so that the crane driver is subject to rather small vibrations. It is important that the crane driver during the luffing in and the luffing out undergoes a rather small up and downwards movement as greater movement could cause sickness and fatigue.

The angular position of the cab link may be modified with respect to the carriage by hydraulic cylinders or screw spindles, control means being present to maintain the longitudinal direction of the cab link substantially parallel to the longitudinal direction of the jib head member during the luffing of the crane.

According to the invention the cab link is connected at one end to the cab, whereas the other end is hinged to at least one telescopic cab backstay member mounted between the backstay member and the strut member of the crane and the lower end of which being hinged to the base of the crane.

In this system the cab link, the strut member and the cab backstay member form a mechanism substantially similar in form as the luffing system of the crane, whereby the strut member of the crane and the strut member of the cab coincide. To avoid heavy driving machines on the cab link or the carriage of the cab link, the carriage could be pulled upwards along the strut member by cables wound on a winch drum.

Preferably said cab backstay member may be retracted and telescoped out by cables wound on a winch drum, the winch drums for the cables of the carriage and the winch drums for the cables of the telescopic cab backstay member being mounted on the same drive shaft.

The telescoping of the cab backstay member is easier if in the entirely luffed in position of the crane the cab link is in contact with a stop member of the carriage and displacement of the carriage leads to retracting and telescoping out of the cab backstay member. In that case winches for operation of the cab backstay member are not necessary.

To make it easier for the cab driver to get in or out his cab, it is preferred that the crane comprises a platform and in the lowest position of the cab carriage and in the entirely luffed in position of the crane the cab is immediately nearby the platform.

BRIEF DESCRIPTION OF THE DRAWINGS

The invention will now further be elucidated with the aid of the figures in which two embodiments are shown.

DISCUSSION OF THE PREFERRED EMBODIMENTS

Figure 1:
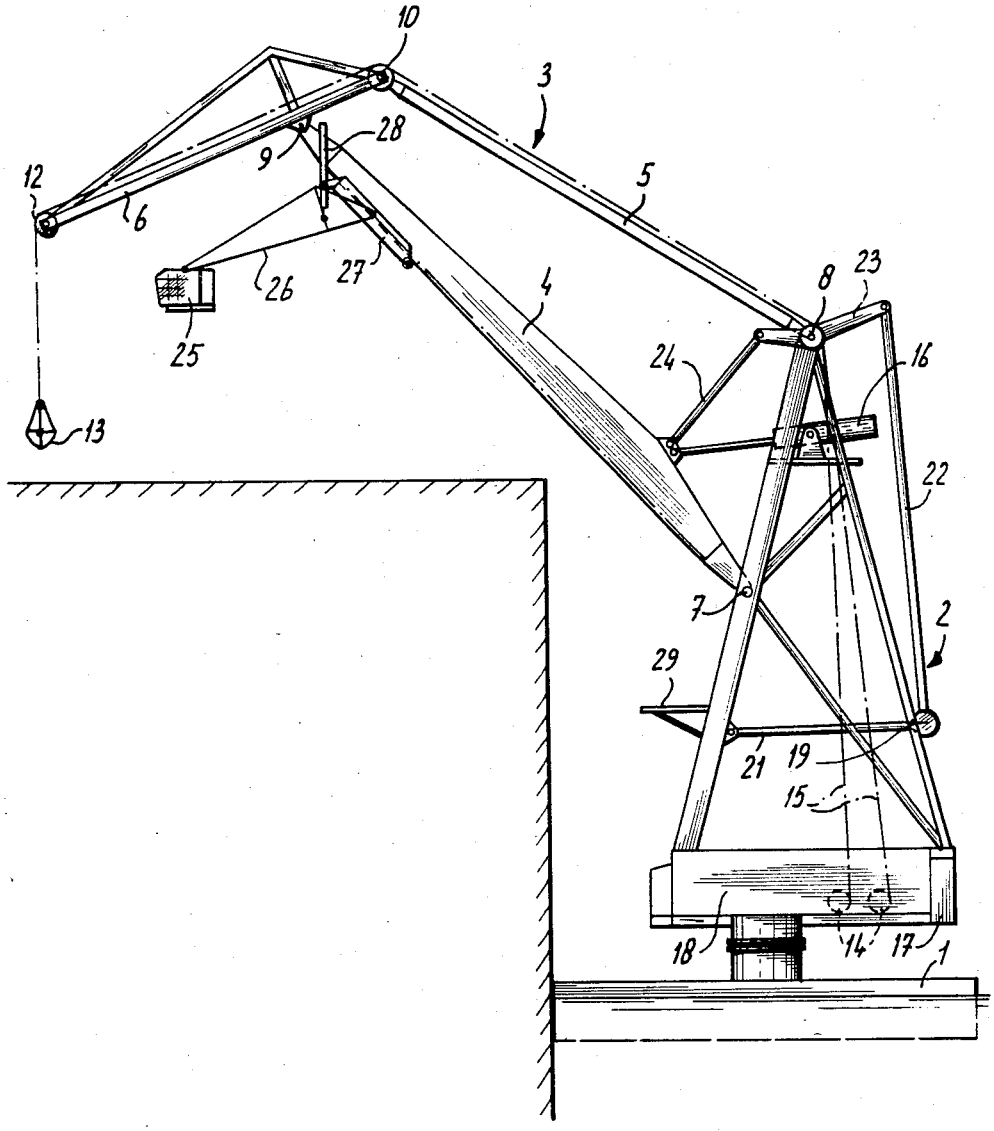
FIGS. 1 and 2 show a side view of a first embodiment of a floating double link level luffing crane according to the invention in the luffed out and luffed in position respectively.
Figure 2:
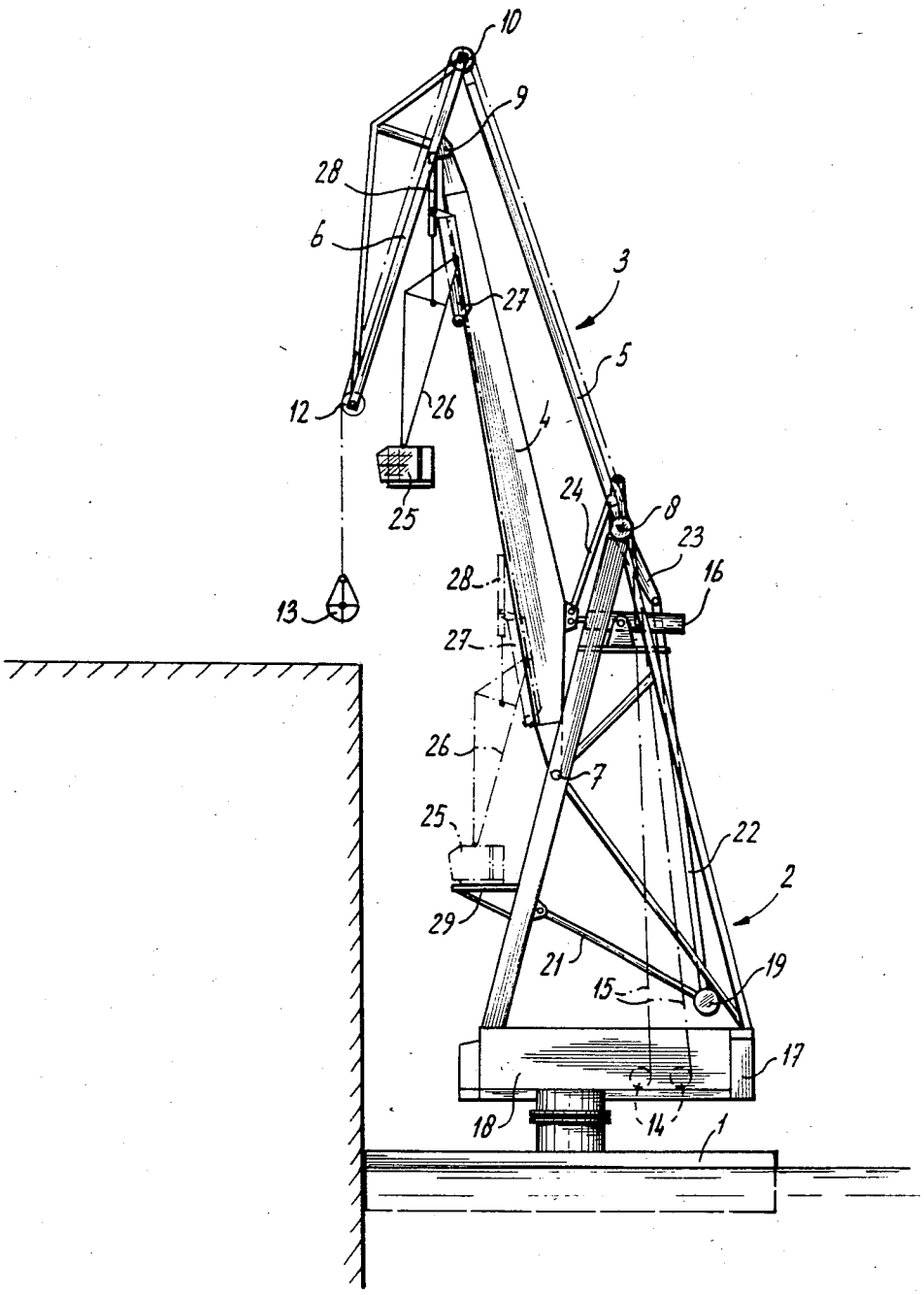
Figure 3:
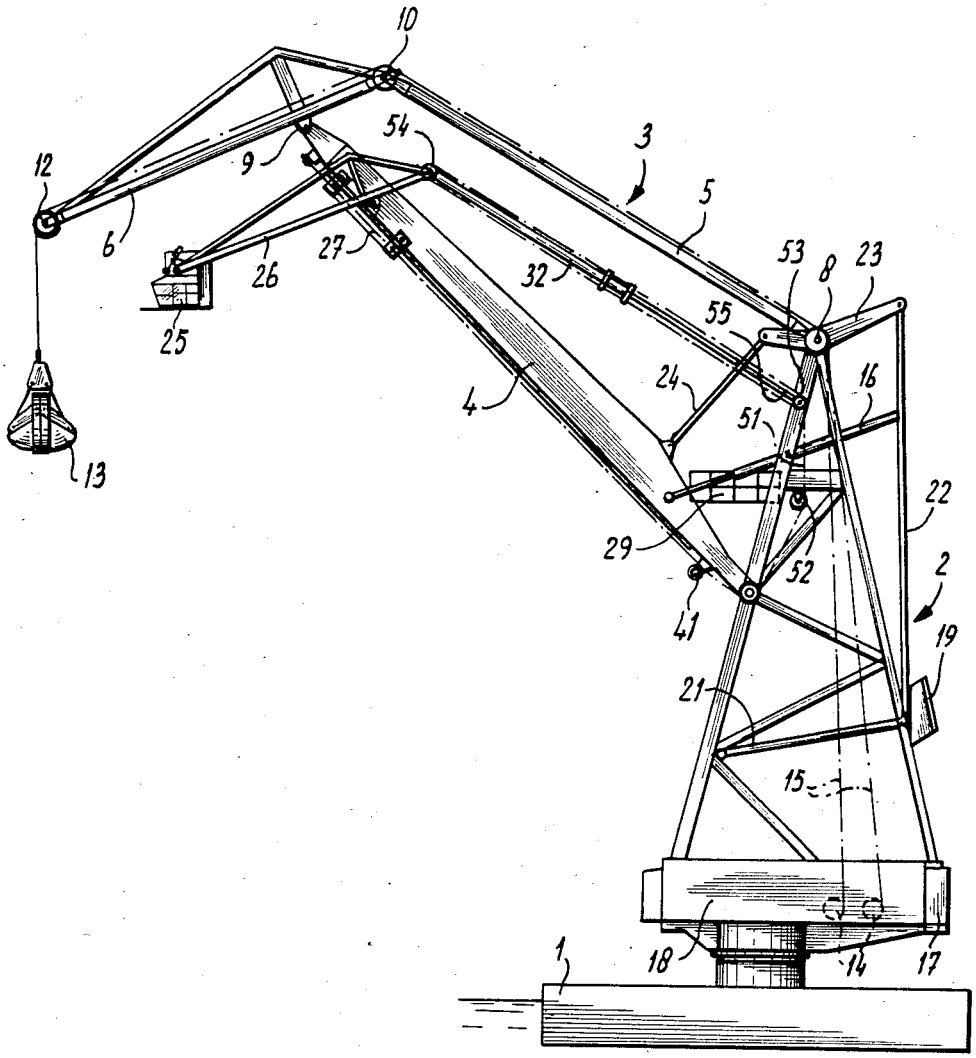
FIGS. 3 and 4 show a side view of the second embodiment of a double link level luffing crane according to the invention in the luffed out and luffed in position respectively.
Figure 4:
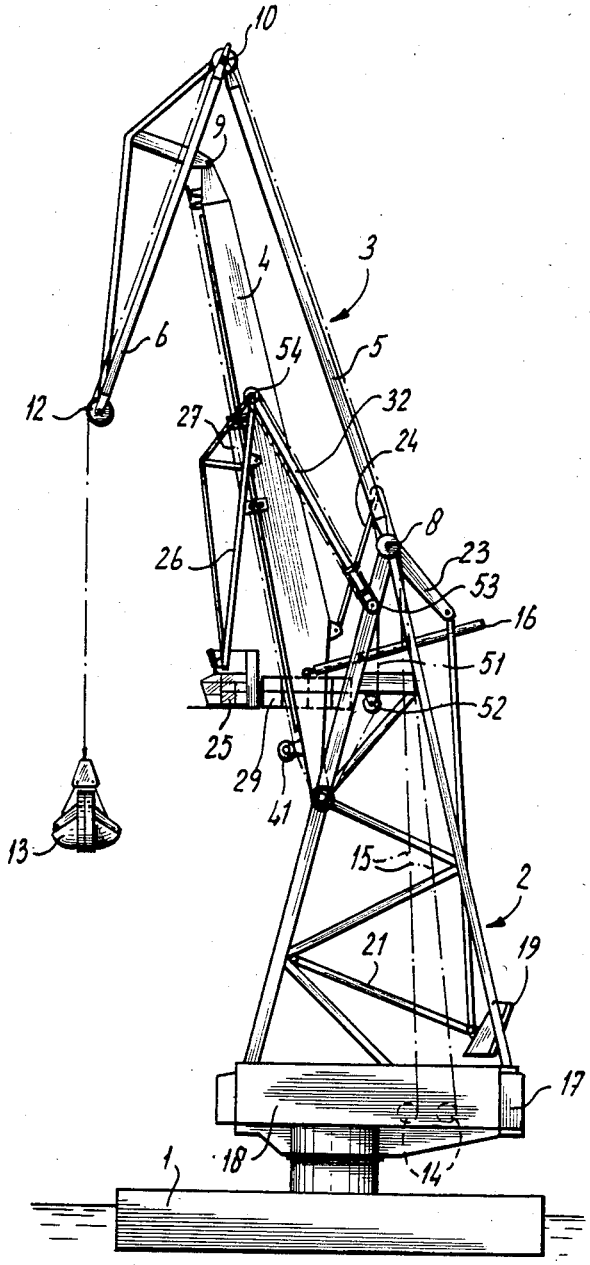

The floating double link level luffing crane according to FIGS. 1 and 2 includes a base 2 turnable mounted on a pontoon 1 and a crane jib 3 which may be luffed in and luffed out and which substantially consists of a strut member 4, a backstay member 5 and a jib head member 6. The lower end of the strut member and the backstay member are hinged to the base 2 at 7, 8 respectively, whereas the jib head member is hinged to the strut member and the backstay member at 9, 10 respectively. In comparing the luffed out position according to FIG. 1 and the luffed in position according to FIG. 2, it appears that the pulley block 12 at the free end of the jib head member 6 remains at substantially the same height during the luffing movement and as a consequence moves along a substantially horizontal path. This means that the length of the free cable of the hoisting equipment remains the same.

The hoisting equipment includes a grab 13, winches 14 and cables 15 extending from the winches over some guide discs to the grab.

The luffing in and luffing out takes place with the aid of a hydraulic luffing cylinder 16. For balancing, use is made of a fixed counterweight 17 forming a part of the machine housing 18 and a movable counterweight 19. The latter is connected through levers 21 to the base 2 and through levers 22, 23 and 24 to the strut member 4.

The crane drivers cab of usual constructions have a fixed position primarily right under hinge point 7. The cab 25 as shown in the drawings is mounted at the end of a cab link 26 which in turn is hinged to a carriage 27 movable along the strut member 4 of the crane.

In FIGS. 1 and 2 the carriage may be driven by hydraulic motors which drive gears meshing into toothed racks not shown along the strut member 4.

To take care that the crane driver during luffing movements of the crane moves along a substantially horizontal path, the angular position of the cab link 26 with respect to the carriage 27 should be modified by means of hydraulic cylinders 28. By a suitable control of these cylinders, the longitudinal direction of the cab link 26 remains substantially parallel to the longitudinal direction of the jib head member 6 of the crane. Compare FIGS. 1 and 2.

To allow the crane driver to reach his cab 25 easily, the cab, in the entirely luffed in position of the crane and the lowest position of the carriage 27, may be just above or next to a platform 29 secured to the base or another part of the crane.

The most important advantage of the disclosed crane is that the drivers cab 25 may always be moved in such a favourable position that the crane driver has the best position for the observation of the loading and unloading. By luffing the crane in and out, the cab will move along a substantially horizontal path which is good for the comfort of the driver.

The rather heavy hydraulic equipment on the carriage 27 is expensive and this equipment may also lead to vibrations of less than 1 Herz which are inconvient for the driver. Therefore the crane according to FIGS. 3–6 will often be preferred.

Corresponding parts in FIGS. 1 and 2 and in FIGS. 3–6 bear the same reference numbers.

The most essential differences between the embodiment according to FIGS. 1 and 2 and the embodiment of FIGS. 3–6 are that the cab link 26 has a hinge connection with at least one telescopic cab backstay member 32 and the carriage 27 may be moved by a winch equipment rather than by hydraulic motors.

Figure 5:
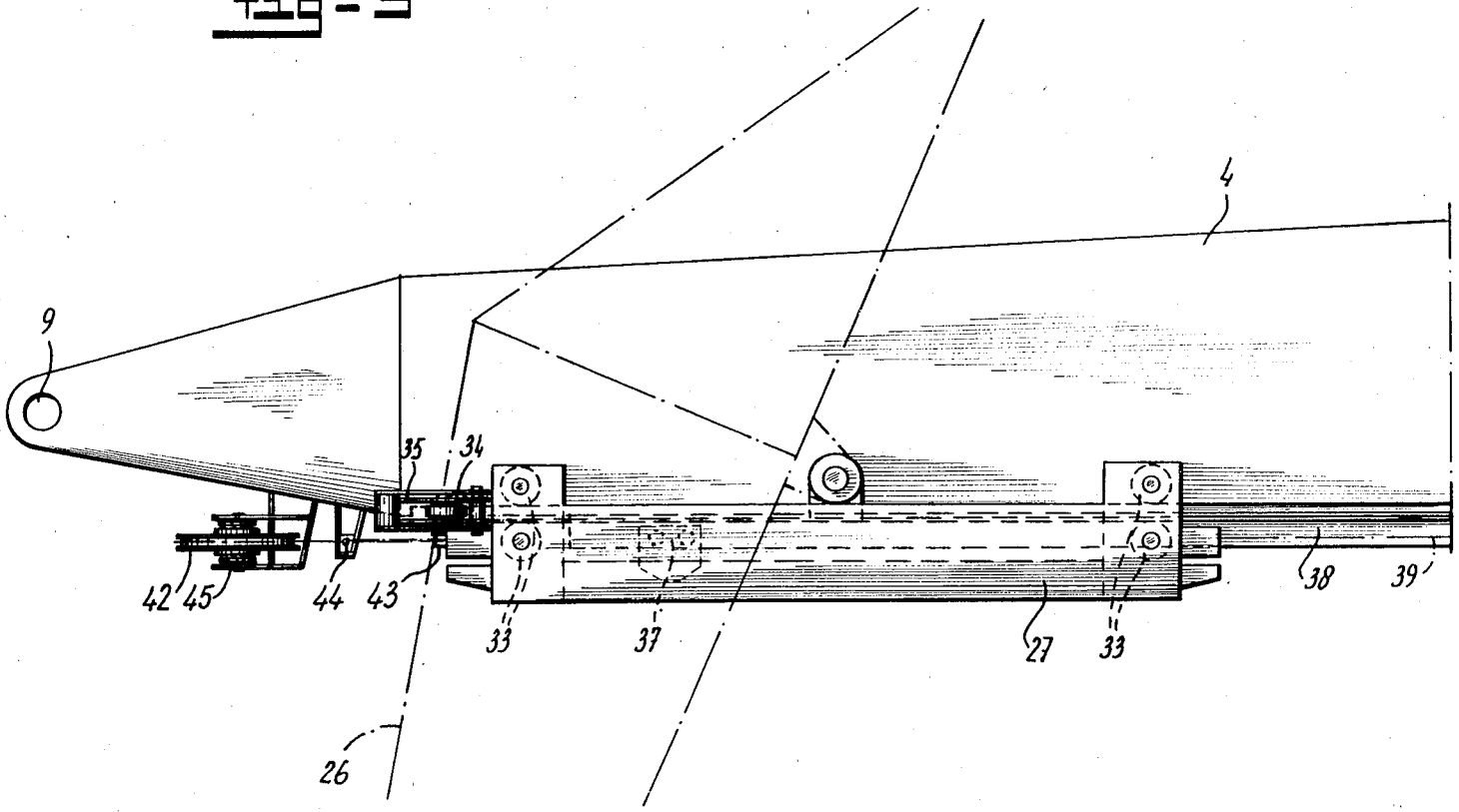
FIG. 5 shows a side view of the end of the strut member including the carriage of the embodiment according to FIGS. 3 and 4.
Figure 6:
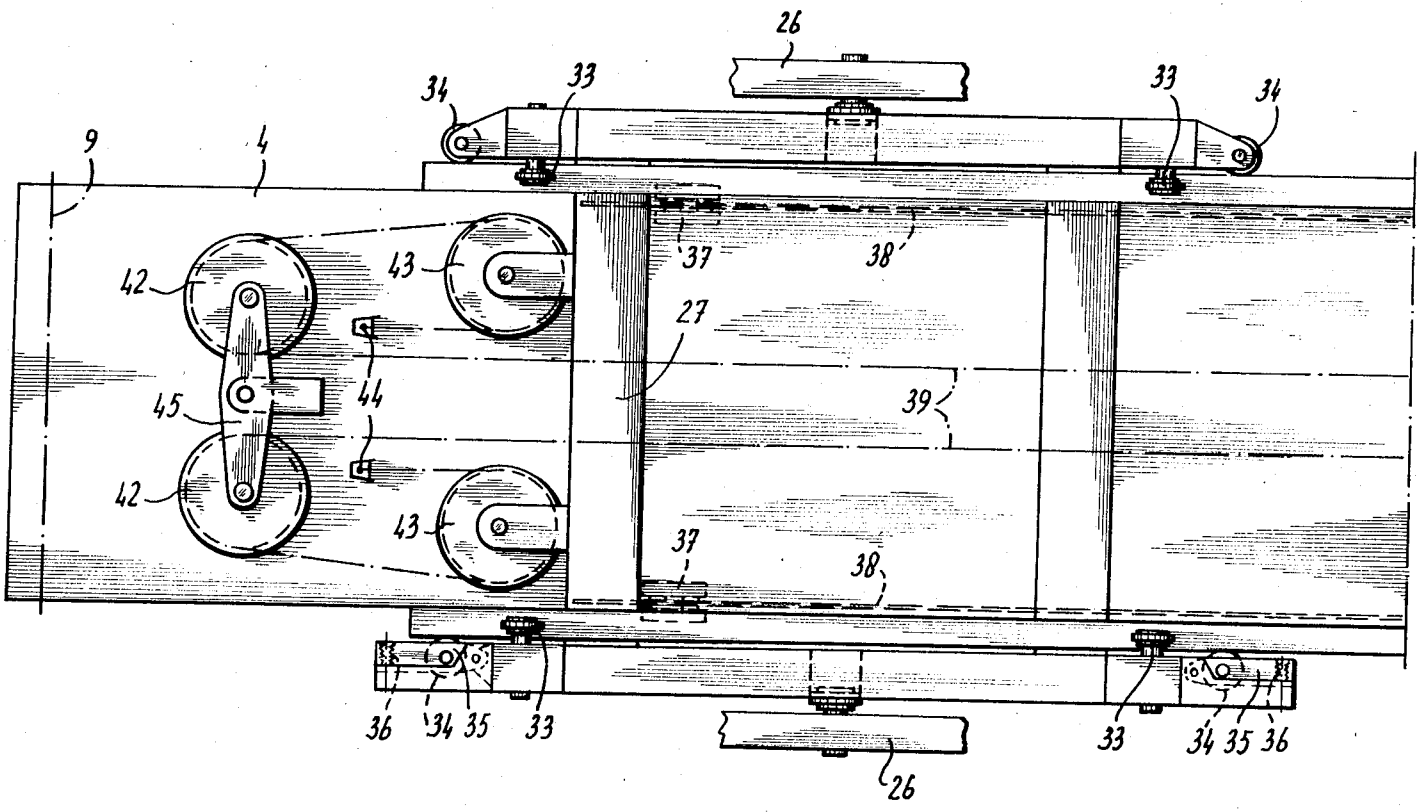
FIG. 6 shows a plan view of the end of the strut member according to FIG. 5.

It appears from FIGS. 5 and 6 that the carriage 27 may be guided with respect to the strut member 4 by sets of wheels 33 and side guide wheels 34. Two wheels 34 as shown in FIG. 6 are mounted on a pivot lever 35 which is pushed by a Belleville spring 36 towards the strut member 4 so that a certain clearance is removed. To block the carriage in the working position and to brake the carriage at the end of a movement, use is made of brake discs 37 co-operating with brake rails 38.

As mentioned above the carriage is displaced by winch equipment. This equipment includes two cables 39 extending each from a winch drum 41 along the strut member 4 over a disc 42 at the end of the strut member, over a disc 43 on the carriage 27 to a fixed connection point 44 on the strut member. Two discs 42 are rotatably mounted with respect to a rocker piece 45 swingably mounted on the strut member 4.

It will be clear that winding the cables 39 on their winch drum the carriage 27 is pulled upwards along the strut member 4, whereas by winding off the cables 39, the carriage moves downwards.

As the cab link 26 is connected with the carriage 27 as well as with the upper end of the cab backstay members 32, these cab backstay members must be made shorter when the carriage 27 is displaced downwardly. Therefore use is made of two cables 51 extending from a winch drum 41 over guide rolls 52, 53 and over a guide roll 54 at the end of the cab backstay members to a fixed point 55 on the base. The winch drums 41 for the cables 51 and the winch drums 41 for the cables 39 are mounted next to each other on the same drive shaft; the winch drums for the cables 51 are made smaller than the winch drums for the cables 39 corresponding to the ratio of the length of the path covered by the carriage 27 and the adjusting path of the cab backstay members 32.

The drums 41 are driven by hydraulic motors the outer circumference of the motors being engaged by band brakes.

When the carriage 27 is pulled upwards, the cables 39 are wound on their winch drums and the cables 51 are wound off from their winch drums. On the other hand the cables 39 will be wound off from their winch drums and the cables 51 will be wound on their winch drums when the carriage 27 moves downwards.

In each operating position of the cab link 26 the length of the cab backstay members 32 is fixed by hydraulic clamping members. The most important aim of the backstay members 32 is to stabilize the lever quadrangle: strut member 4, cab link 26, base 2 and cab backstay member 32; in each working position the cab will move along an approximately horizontal path when the crane is luffed in or luffed out without hydraulic driving means.

Several modifications of the shown and disclosed constructions are possible within the scope of the claims.

An alternative construction similar to FIGS. 3–6 eliminates the use of winch equipment for backstay members 32". Instead when the cab link is in an entirely luffed in position, the crane engages a stop member of the cab with a big force (for instance about 30.000N). As a consequence thereof the cab link can not pivot when the carriage 27 is moved along the strut member 4 by the cables 39, whereas the cab backstay members 32 will telescope in and telescope out. To move the cab of this alternative construction to another height position, the following actions must be carried out; the crane is completely luffed in; the backstay members 32 and the carriage 27 are unlocked; the carriage is brought to the desired height by the cables 39 and the winch equipment 41 whereby the backstay members 32 will automatically slide in and slide out; finally the cab carriage 27 and the backstay members 32 are locked.

There are also other possibilities to prevent the temporary pivoting movement between the cab link 26 and the carriage 27 and to provide the possibility of retracting and telescoping out the backstay members 32 automatically when the carriage 27 is displaced.

I claim:

1. A double line level luffing crane comprising:

a base, a jib including a strut member having first and second ends, said first end of said strut member hinged to said base, a backstay member having first and second ends, said first end hinged to said base, a jib head member having first and second ends, said first end including means suspended therefrom adapted to hoist a load, said second end being hinged to said second end of said strut member and to said second end of said backstay member, drive means for luffing said jib in and out, means coupled to said first end of said jib head for hoisting a load, a driver cab, a cab link having first and second ends, said driver cab hinged on said first end of said cab link, a carriage movably mounted on said strut member, said cab link being pivotally mounted on said carriage, at least one telescopic cab backstay member being mounted between said second end of said cab link and said base, cable means mounted on said telescopic cab backstay member, said cable means having a respective first and second end, said first end of said cable means being mounted on said base and drive means mounted on said strut member and operatively connected to said second end of said cable means and to said carriage for moving said carriage along said strut member and simultaneously extending or retracting said telescopic cab backstay member.

2. The double link level luffing crane as claimed in claim 1 having a stop member, said cab link being engagable with said stop member when said crane is in a completely luffed in position.

* * * * *

UNITED STATES PATENT AND TRADEMARK OFFICE

CERTIFICATE OF CORRECTION

PATENT NO. : 4,606,469

DATED : August 19, 1986

INVENTOR(S) : Jan D. A. Van Deijk

It is certified that error appears in the above—identified patent and that said Letters Patent is hereby corrected as shown below:

On the Title Page:

[73] Assignee. Change Frans Swarttour B.V.

to --Frans Swarttouw B.V.

Signed and Sealed this

Seventh Day of April, 1987

*Attest:*

DONALD J. QUIGG

*Attesting Officer*

*Commissioner of Patents and Trademarks*